US008028482B2

(12) United States Patent
Vasquez Ruiz Del Arbol

(10) Patent No.: US 8,028,482 B2
(45) Date of Patent: Oct. 4, 2011

(54) DEVICE FOR FORMING JOINTS IN CONCRETE WORKS

(76) Inventor: Jose Ramon Vasquez Ruiz Del Arbol, Barcelona (ES)

( * ) Notice: Subject to any disclaimer, the term of this patent is extended or adjusted under 35 U.S.C. 154(b) by 889 days.

(21) Appl. No.: 10/562,850

(22) PCT Filed: Jul. 7, 2004

(86) PCT No.: PCT/ES2004/070047

§ 371 (c)(1),
(2), (4) Date: May 8, 2006

(87) PCT Pub. No.: WO2005/007970

PCT Pub. Date: Jan. 27, 2005

(65) Prior Publication Data

US 2006/0277856 A1 Dec. 14, 2006

(30) Foreign Application Priority Data

Jul. 17, 2003 (ES) ..... 200301687

(51) Int. Cl.
*E04B 1/62* (2006.01)

(52) U.S. Cl. ..... 52/393; 52/364

(58) Field of Classification Search ..... 52/393, 52/364, 371, 373, 638, 641, 646, 648.1, 649.1
See application file for complete search history.

(56) References Cited

U.S. PATENT DOCUMENTS

| | | | | |
|---|---|---|---|---|
| 1,505,174 A | | 8/1924 | Triol | |
| 1,921,081 A | * | 8/1933 | Heltzel | 404/51 |
| 1,978,278 A | * | 10/1934 | O'Brien | 404/50 |
| 2,321,067 A | | 6/1943 | De Witt | |
| 3,497,172 A | * | 2/1970 | Welch | 249/3 |
| 4,506,481 A | * | 3/1985 | Witschi et al. | 52/127.2 |
| 4,660,346 A | * | 4/1987 | Burger et al. | 52/653.1 |

FOREIGN PATENT DOCUMENTS

| | | |
|---|---|---|
| AU | 200301687 | 7/2003 |
| EP | 1 647 630 B1 | 2/2010 |

OTHER PUBLICATIONS

English Abstract of JP 2000-08309 dated Jan. 11, 2000.
Communication under Rule 71(3) EPC.
Decision to grant a European patent pursuant to Article 97(1) EPC.
Correction of a decision under Rule 140 EPC.
Certificate of Invention Patent from the Chinese Patent Office for Patent ZL200480020090.5.
Patent Certificate from the India Patent Office for Patent 236032.

* cited by examiner

*Primary Examiner* — Basil Katcheves
(74) *Attorney, Agent, or Firm* — Ladas & Parry LLP

(57) ABSTRACT

The invention relates to a device for forming contraction joints in concrete works. The invention comprises a plurality of assemblies which are made from a concrete-separating material and which are mounted to rigid linear elements in an alternate manner on one side and then the other of the surface crack line on the upper face of the concrete work surface, leaving spaces therebetween for cracking. The inventive device enables the adjacent slabs formed by the contraction joint to be fixed, thereby improving the resistance performance thereof. The invention is suitable for in situ concrete works, such as roads, channels, esplanades, sewers, tunnels, railways, dykes, etc.

6 Claims, 3 Drawing Sheets

DEVICE FOR FORMING JOINTS IN CONCRETE WORKS

FIELD OF THE INVENTION

The present invention refers to a device for forming joints in concrete works or in works of other materials such as cemented gravel, in which the shrinkage phenomenon occurs, and more particularly to a device allowing for the slabs or other concrete members separated by the joints to be embedded with one another, or embedded in one direction and articulated in the other.

The invention is applicable in linear works such as streets, roads, canals, collectors, highways, railways, docks, in surface works such as port and airport subgrades, as well as in spatial works such as walls, tanks, floor slabs, roofings, prefabricated articles and dams.

BACKGROUND OF THE INVENTION

Spanish patent application ES 2,149,103 A1 of the same applicant discloses a process of articulated interlocking between concrete slabs achieving that the edges of said slabs have recesses and projections interlocking with one another in adjacent slabs.

The essential element for this is the use of means placed alternately on either side of the plane of the axis of the joint perpendicular to the ground, tilted with the same angle with regard to the ground, and the tilting direction alternately varying on either side of said plane. As the concrete cracks due to shrinkage or due to the application of loads, these means allow the formation of said recesses and projections.

Said patent discloses several concrete means formed from metal meshes which, although they do achieve the mentioned objective, have some drawbacks which are aimed to be solved by the present invention.

SUMMARY OF THE INVENTION

In the description of the present invention, and to facilitate the understanding thereof, a regular pavement on a subgrade or ground will be used as an example of a concrete work in which the device for forming joints object of the present invention is applied. The concreting process accordingly consists of the formation of a concrete layer of uniform height on the subgrade or ground in question. For their part, the joints formed by the shrinkage of concrete imply dividing the pavement into slabs.

A person skilled in the art will easily understand that if the upper side of the pavement is referred to as a horizontal surface, it is because it is assumed that the surface of the ground is horizontal, this not limiting the application of the invention to horizontal pavements. A person skilled in the art will likewise easily understand that if the concrete work is not a pavement but rather a wall or a canal, the meaning of the terms such as upper side, ground or slab must be translated to the different typology of these works.

Therefore the object of the present invention is a device for forming contraction joints in concrete works constituted of a plurality of trays of a concrete divider material assembled on stiff linear members in an alternating manner on either side of the superficial crack line on the upper side of the concrete surface, and leaving gaps between them to allow for the cracking.

The device can also include supports for fixing the position of said stiff linear members and facilitating the correct positioning of the trays.

Said trays are preferably configured in the form of a broken surface with an upper portion and a lower portion parallel and tilted with regard to the horizontal plane, forming an acute angle therewith, and with at least one almost horizontal portion slightly tilted downwards, intended for forming notably horizontal adjacent slab support surfaces.

The device preferably includes a waterproofing joint arranged along the device on the upper portion of the plurality of trays and the gaps between them.

This waterproofing joint furthermore serves to indicate the site where the cracking of the concrete is to occur, which will be alternately "directed" on either side of said joint in different areas defined by said trays in order to leave the edges of the members resulting from the cracking alternately supported with one another. The cracking automatically occurs due to shrinkage or due to load.

The almost horizontal portion of the trays determines that the crack is notably horizontal in the corresponding areas of the concreting members, an efficient support between adjacent slabs is thereby obtained even though the crack width is large. The transmission of vertical loads and an embedding are achieved with such notably horizontal crack area when tensions occur on the upper side. When the load is on the joint, its behavior is that of a ball joint.

The purpose of this invention is similar to that of the invention disclosed in ES 2,149,103 A1: to provide a means for eliminating the problems associated to shrinkage of the concrete by achieving the embedding of the adjacent slabs formed by the contraction joint, thereby achieving a substantial improvement in the carrying capacity of concrete pavements with the same type and amount of material. However, the device object of this invention is different from those disclosed in ES 2,149,103 A1.

Other features and advantages of the present invention will be understood from the following detailed description of an illustrative and by no means limiting embodiment thereof in relation to the attached drawings.

DETAILED DESCRIPTION OF THE INVENTION

Figure 1:
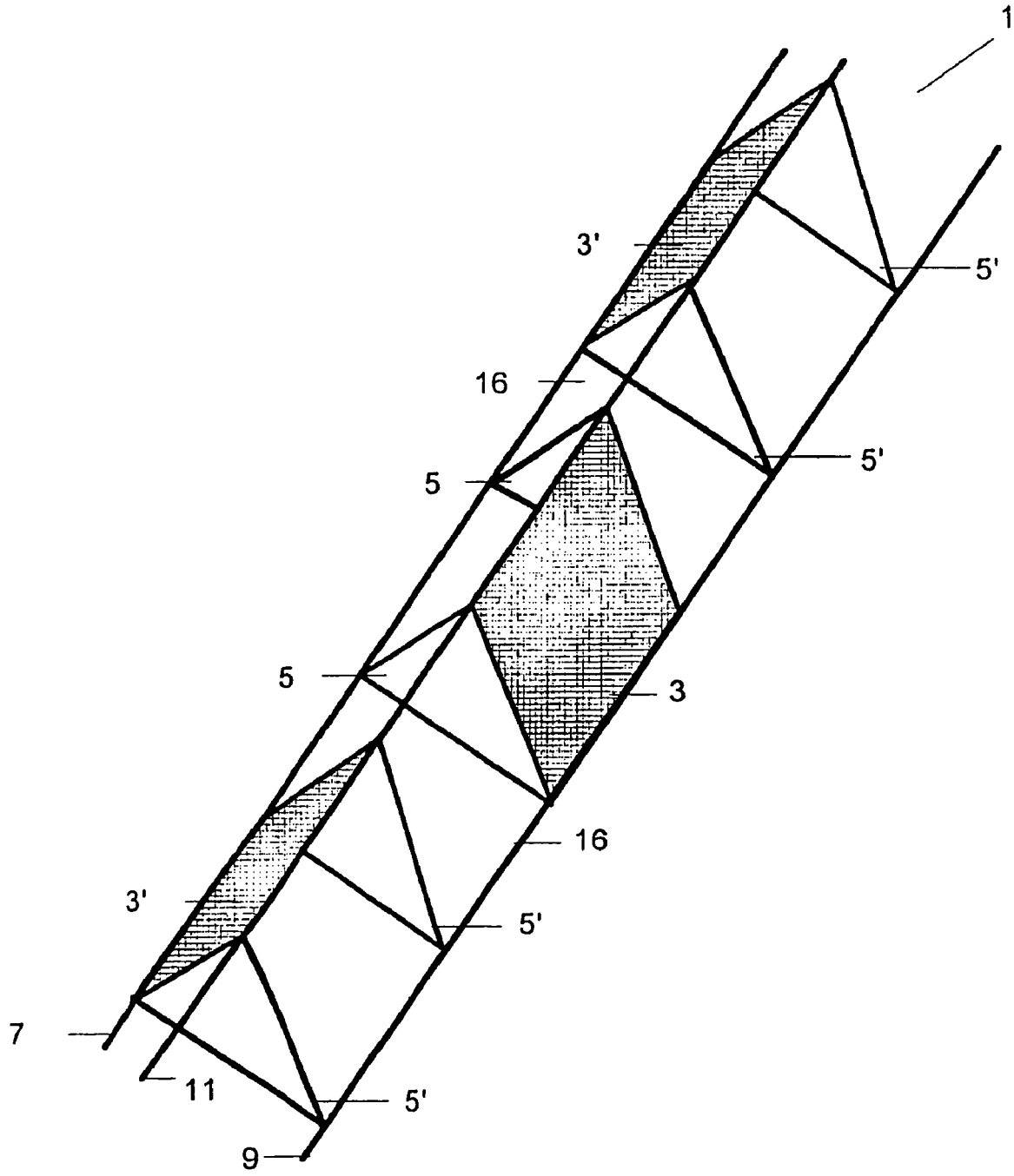
FIG. 1 shows a schematic perspective view of a device for forming contraction joints in concrete works including a plurality of trays supported at their ends on a triangular support, which are assembled on stiff linear members.

In reference to FIG. 1, it can be seen that the device 1 for forming contraction joints in concrete works according to the invention includes three basic components: members formed by equal trays 3, 3', supports 5, 5' and stiff linear members 7, 9, 11.

The device 1 is assembled in situ at the work site in question, in a warehouse or in any suitable site, in the position and with the length provided for forming the contraction joints.

Said trays 3, 3', which will usually be prefabricated, are alternately arranged on either side of the superficial line provided for the crack of the concrete, situated on the same vertical plane as the stiff linear member 11, usually leaving gaps 16 between them, although it may be useful to position the trays 3, 3' one against the other for certain applications.

A fourth component of the device 1 (not shown in FIG. 1) is a waterproofing joint 40 (FIG. 4) situated on the upper portion thereof.

Although the supports 5, 5' are not indispensable, it is convenient to use them as correct positioning means of the stiff members 7, 9, 11. They additionally facilitate positioning of the trays 3, 3' with the suitable inclination.

The alternating arrangement of trays 3, 3' defines a triangular prismatic shape of the device 1.

Figure 2:
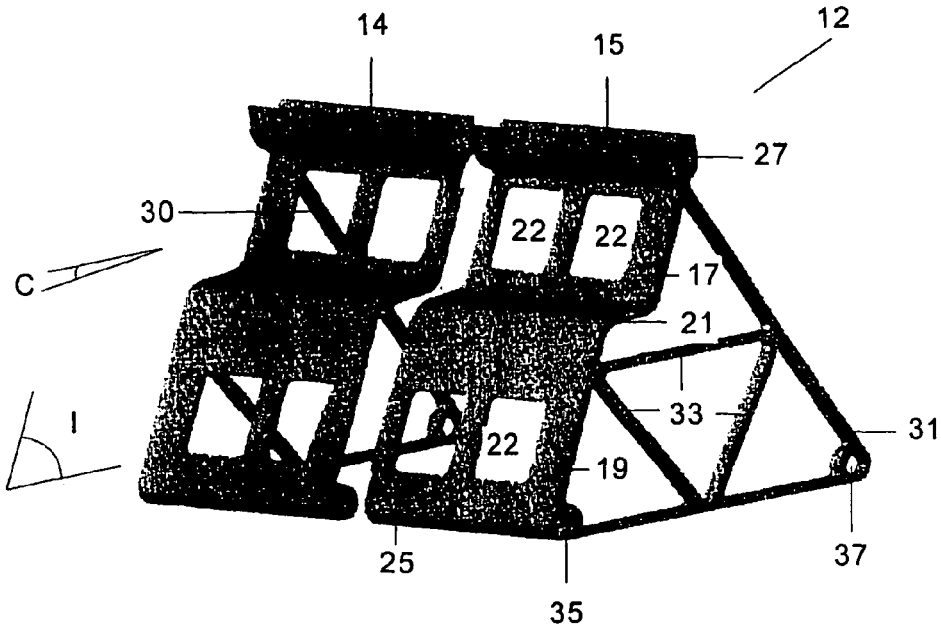
FIG. 2 shows a tray formed by two half-trays including an almost horizontal central portion and openings regularly distributed on its upper and lower portions.

In the preferred embodiment shown in FIG. 2, a tray 12 formed by two half-trays 14, 15, equal with the exception of the position of the supports 30, 31, can be seen. Half-tray 15 has a broken surface form with an upper portion 17 and a lower portion 19 that are parallel and tilted at an acute angle I with regard to the horizontal plane, and a central, almost horizontal portion 21. The upper portion 17 and lower portion 19 include regularly arranged open areas 22.

It is calculated that the suitable inclination of portions 17 and 19 with regard to the horizontal (angle I in FIG. 2) must be comprised between 40° and 80°, and that of the central portion 21 (angle C in FIG. 2) must be comprised between 0° and 15°. The inclination of portions 17 and 19 can be different.

The half-tray 15 is supported at one of its ends on the triangular type support 31, with a broken side such as the surface of the tray 15, with an inner reinforcement 33. The support 31 has orifices 35, 37 at its lower base through which the stiff linear members allowing the assembly of the device are passed. The half-tray 15 in turn has a conduit 25 at its lower portion for the same purpose, and therefore with the same section, although it does not necessarily have to be completely closed as is shown in FIG. 2.

Figure 4:
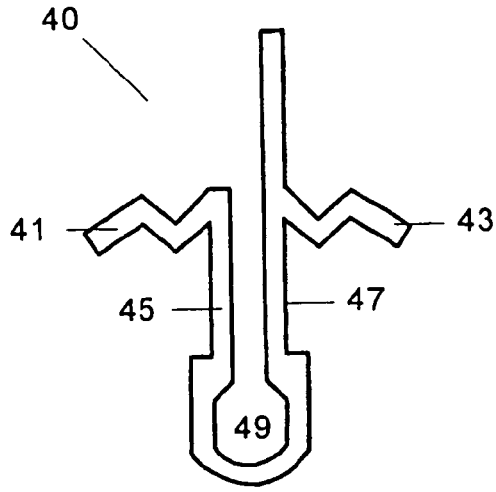
FIG. 4 shows an elevational view of a waterproofing joint suitable for a device for forming joints using half-trays such as those shown in FIG. 2.

On the other hand, the upper edge 27 of the half-tray 15 is configured in a U shape to facilitate the assembly of a waterproofing joint 40 such as the one shown in FIG. 4, wherein two hooks 41, 43 are seen, one on either side, for gripping the cracked concrete slabs, lips 45, 47 allowing for the horizontal separation thereof.

The head or upper edge 27 of the half-tray 15 includes small projections assuring the fixing of the joint 40 by means of a clipping mechanism.

The half-tray 15 and the support 31 in this embodiment are solidly joined together at one end. In alternative embodiments, it is possible for the supports to not be solidly joined to the half-tray and to be situated at the center thereof rather than at one of its ends. A determining factor in the choice of either alternative is the height which the device must have. In this sense, it can be observed that the configuration shown in FIG. 2 allows for the assembly of a double-height device by fitting the conduits 25 of one row of semi-trays in the heads 27 of another row of semi-trays.

Figure 3A:
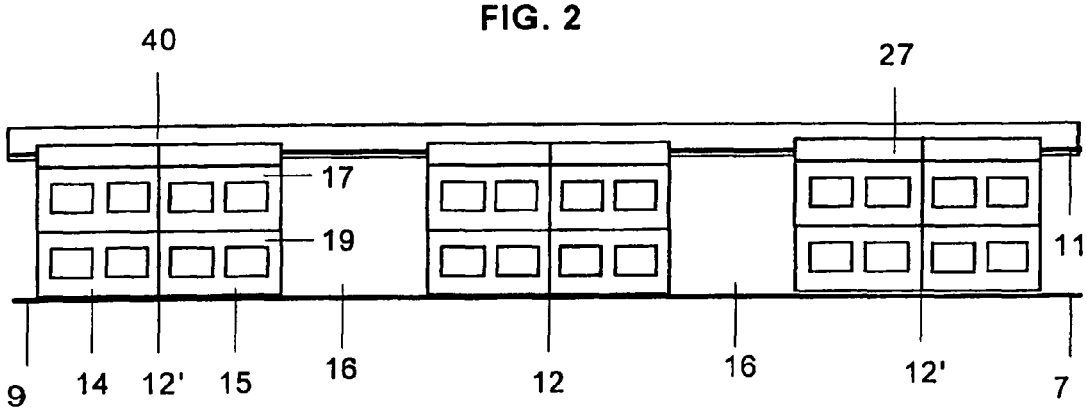
FIGS. 3*a* and 3*b* show schematic elevational and plan views, respectively, of a device for forming joints using half-trays such as those shown in FIG. 2.
Figure 3B:
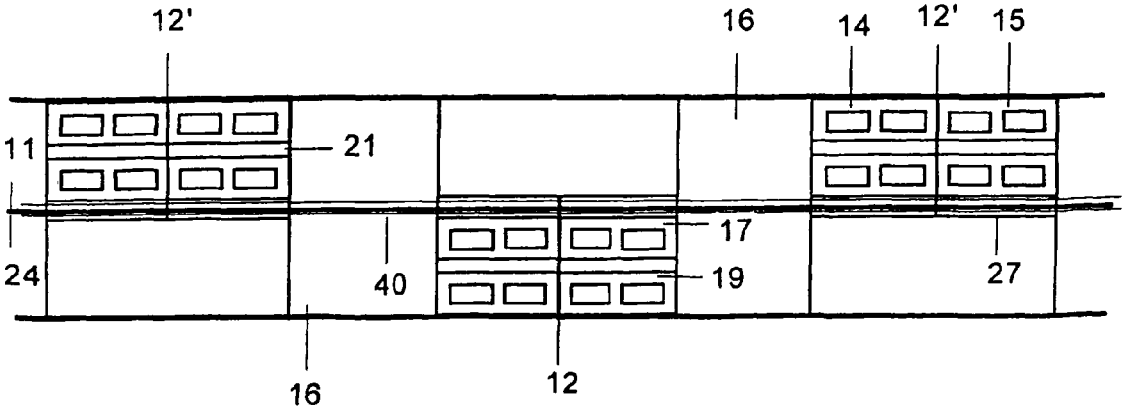

In reference to FIGS. 3*a* and 3*b*, a device 1 for forming joints with trays 12, 12' alternately arranged on either side of the superficial crack line 24 (coinciding with the stiff linear member 11) with gaps 16 between them can be seen. The trays 12 and 12' are formed by pairs of half-trays 14, 15, which are equal with the exception that each of them is solidly joined to the triangular support 31 at a different end, and they are assembled on stiff linear members 7 and 9 which are made to pass through the orifices 35 and 37 of the supports 30, 31 and through the conduit 25 of the trays 15.

On the end far from the supports 30, 31, the half-trays 14 and 15 can be configured such that they can be fitted together.

A third linear member 11 has been added in FIGS. 3*a* and 3*b* which, in this case, serves to stiffen the waterproofing joint 40, and which is situated in the cavity 49 of its lower portion, which is assembled on the upper edge 27 of the half-trays 14, 15.

The material constituting the trays 3, the semi-trays 14, 15 and the supports 5, 31 can be polypropylene, PVC, polyamide, steel sheet or a sheet of another material suitable for serving as a concrete divider member.

The material constituting the waterproofing joint 40 can be gum, PVC, rubber or another waterproof material.

Highly stiff plastic bars or steel bars can be used as stiff linear members 7, 9, 11.

All the components of the device are susceptible to prefabrication. Their reduced weight and their shape allow for transporting them in stacks to the work site where they are assembled in the manner indicated and positioned on the ground in the sites provided for the joint.

Once assembled, the device for forming contraction joints according to the present invention has a certain bending capacity allowing it to adapt itself to the surface on which the concrete will be poured even if it is not perfectly level. Its configuration and particularly the presence of openings in the trays and supports facilitates the positioning of the concrete without moving the device. As a complement, nails for fixing it to the terrain immobilizing the members 7 and 9, and therefore the device 1, are needed.

The fixing of the waterproofing joint 40 in the head 27 of the semi-trays 14, 15 in turn assures the correct positioning thereof. The waterproofing joint 40 can open its lips 45, 47 and be anchored to the concrete slabs on either side of the crack, allowing the expansion and shrinkage of the concrete, being closed on the underside in order to be waterproof both in its upward and downward movement. As previously indicated, a stiff linear member 11 can be found inside this waterproofing joint 40 if greater stiffness of the assembly were required.

In this sense, the joint 40 could be carried out such that the lips 45 and 47 were joined at their lower portion, i.e. at the upper portion of the cavity 49.

The device for forming contraction joints according to the present invention includes gaps 16 between alternating trays 3, 3'; 12, 12' so that the crack of the concrete resulting from shrinkage or from the action of a load can easily vary its orientation to either side of the superficial crack line by following the surfaces of said trays 3, 3'; 12, 12'.

The optimum size of the gaps 16 between alternating trays 3, 3'; 12, 12' is comprised between one and two times the length of the base of the support of said trays.

The device 1 for forming contraction joints according to the invention can also be used as a formwork, which is useful for demarcating the conclusion of a work at the end of a working day or for carrying out a linear work in two semi-roadways at different moments in time in which a longitudinal joint is to be formed according to the present invention. For these special cases, the trays and triangles cannot incorporate openings and they must be positioned with no gaps between two alternating trays in order to achieve an effective closing preventing the concrete from coming out.

Figure 5A:
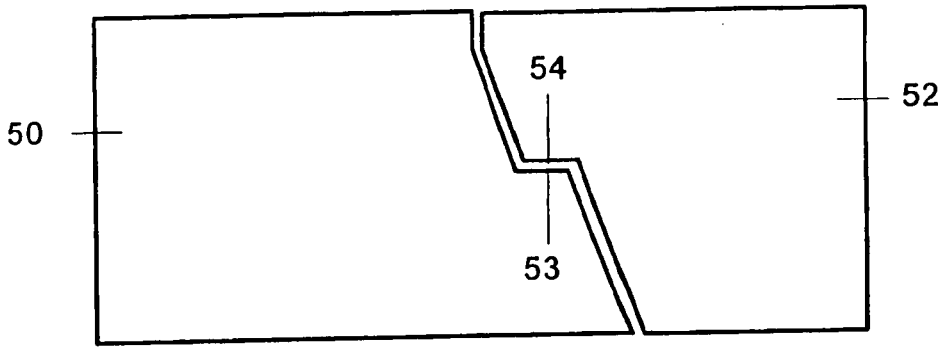
FIGS. 5*a* and 5*b* show elevational views of the ends of two adjacent slabs in the joint formed using the device illustrated in FIGS. 2 and 3 in areas occupied by trays arranged on different sides of the superficial crack line.
Figure 5B:
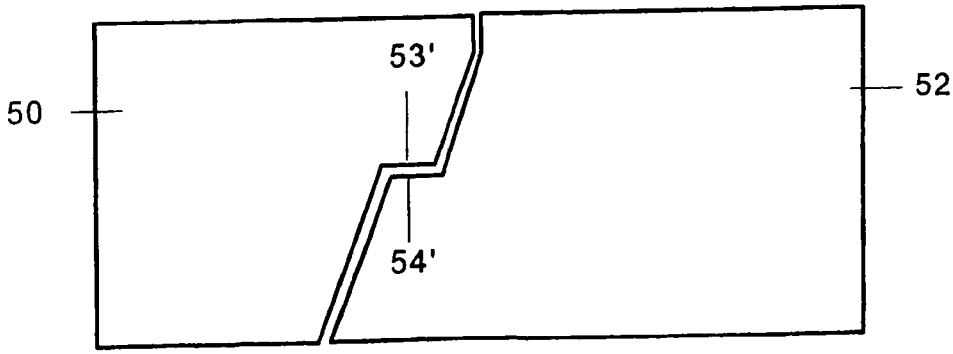

In reference to FIGS. 5*a* and 5*b*, the embedding occurring between the slabs 50 and 52 formed in a pavement (in concrete works other than pavements, the members separated by the joints would have another shape), which is facilitated in the event of very wide cracks due to the existence of flat surfaces 53, 54; 53', 54' corresponding to the areas 21 of the trays 12, 12', is observed.

As concrete cracks, the two slabs 50, 52 are formed with a different configuration in the areas corresponding to the alternating trays 12, 12', respectively.

In the area corresponding to one tray 12 (FIG. 5*a*), the horizontal span 54 of slab 52 is situated above the horizontal span 53 of slab 50, and slab 52 is prevented by slab 50 from moving downwards.

However, in the area corresponding to tray 12' (FIG. 5*b*), span 54' of slab 52 is situated under the horizontal span 53' of slab 50. Therefore, in this area slab 52 is prevented from moving upwards since the horizontal span of slab 50 is above it. Therefore the shear stresses are transmitted among the slabs and, generally, among the cracked members when the concrete works are other than pavements.

On the other hand, the bending moments are also transmitted. If the area of the joint were to be raised up due to the effect of an internal load of the slab 50, span 53 will be higher than span 53' as it is farther from the load tending to sink the slab in the center and raising it up on the edge. According to FIG. 5*b*, span 53' is higher than span 54' of slab 52. In turn, span 54' raising up in slab 52 is higher than span 54 as it is farther from the center of the slab 52. Therefore the order of the height or height level reached would be 53, 53', 54', 54. This is not possible since, by looking at FIG. 5*a*, portion 54 is above portion 53. For it to be above and below at the same time, they must be at the same height level. In other words, the line joining one support 53-54 with the other one 53'-54' is a line parallel to the horizontal (parallel to the surface). Therefore there is no turning between slabs 50 and 52, and the bending moments are transmitted.

The horizontal portion 21 of the trays 12, 12' always works under compression, therefore its durability is assured. It is recommended that it be thin and/or that its elastic limit be high so that deformation thereof by compression is small and the transmission of loads is efficient. Any downward movement of a slab must be transmitted to the other one in the same magnitude; if the downward movement is identical, the transmission of loads efficacy is 100%. In tests carried out with the falling weight deflectometer, an almost perfect behavior is reflected in a total of 60 tested cracks (mean greater than 99%, and no measurement below 93%).

The following advantages concerning the device for forming contraction joints according to the invention with regard to the prior art can be mentioned:

Adaptability to the terrain.

Industrial manufacturing of the components.

Inexpensive and easy light weight transporting by pieces.

Transmission of the shear stresses even though the width of the crack is large (more than 1 cm), suitably sizing the horizontal portion of the trays.

Transmission of the bending moments if the central surface is completely horizontal (parallel to the grade line).

Good integration of the waterproofing joint.

The waterproofing joint does not drag the device for forming joints if it slightly projects from the grade line, given that it is a member that can give. For this purpose it is of interest, as shown in FIG. 2, that the axis of the head 27 is moved with regard to the axis of portion 17 of the tray.

The philosophy is not to reinforce a concrete area and prevent a crack from advancing in one direction, but rather to weaken an area in order to guide the crack, which is easier and less expensive.

It is possible to combine the trays so that an embedding occurs in the two directions of the bending moment.

An especially interesting advantage of the present invention concerns railways, given that it allows for the construction thereof on the basis of concrete, the respective slabs being duly embedded with one another. This feature would allow for considering the elimination of the current rails as the concrete railway is able to carry out their function.

The present invention is not limited to the described embodiments, but rather to any other embodiment comprised within the scope defined by the following claims.

The invention claimed is:

1. A device (1) for forming contraction joints in concrete works, comprising:

a plurality of stiff linear members (7, 9, 11) connected by supports (5, 5') between them such that the stiff linear members (7, 9, 11) form a three-dimensional triangular structure having two faces and a base; and a plurality of trays (3, 3'; 12, 12') of a concrete divider material, alternately arranged on the two faces of the triangular structure on either side of one of the stiff linear members (11), having gaps (16) between the trays (3, 3'; 12, 12'), wherein at least one tray is formed by two half-trays (14, 15), each half-tray (14, 15) having a broken surface formed with an upper portion (17) and a lower portion (19) that are parallel to each other and tilted at an acute angle I with respect to a base of the triangular structure, the upper portion (17) and the lower portion (19) being connected by a central portion (21) that is at an angle C with respect to the base of the triangular structure.

2. The device (1) for forming contraction joints in concrete works according to claim 1, wherein the upper portion (17) and the lower portion (19) each include open areas (22).

3. The device (1) for forming contraction joints in concrete works according to claim 1, wherein the acute angle I is between 40 and 80 degrees.

4. The device (1) for forming contraction joints in concrete works according to claim 1, wherein the angle C is between 0 and 15 degrees.

5. The device (1) for forming contraction joints in concrete works according to claim 1, further comprising a waterproofing joint (40) having a plurality of lips (45, 47) and having a U-shaped lower portion for receiving one of the stiff linear members (11).

6. The device (1) for forming contraction joints in concrete works according to claim 5, wherein an upper edge (27) of the half-trays (14, 15) is configured in a U shape to receive the U-shaped lower portion of the waterproofing joint (40).

* * * * *